United States Patent [19]

Martin

[11] Patent Number: 4,953,477

[45] Date of Patent: Sep. 4, 1990

[54] METHOD AND APPARATUS FOR REGULATING THE FURNACE OUTPUT OF INCINERATION PLANTS

[75] Inventor: Johannes J. E. Martin, Munich, Fed. Rep. of Germany

[73] Assignee: Martin GmbH fur Umwelt- und Engerie-Technik, Munich, Fed. Rep. of Germany

[21] Appl. No.: 384,214

[22] Filed: Jul. 21, 1989

[30] Foreign Application Priority Data

Jul. 29, 1988 [DE] Fed. Rep. of Germany ..... 3825931

[51] Int. Cl.[5] ..... F23N 5/02

[52] U.S. Cl. ..... 110/190; 110/300; 110/346

[58] Field of Search ..... 110/190, 299, 300, 291, 110/346

[56] References Cited

U.S. PATENT DOCUMENTS

| | | | |
|---|---|---|---|
| 4,473,013 | 9/1984 | John et al. | 110/291 X |
| 4,495,872 | 1/1985 | Shigaki | 110/190 |
| 4,537,141 | 8/1985 | Brunner | 110/299 X |
| 4,762,489 | 8/1988 | Schmits et al. | 110/300 X |
| 4,838,183 | 6/1989 | Tsaveras et al. | 110/190 |

FOREIGN PATENT DOCUMENTS

| | | |
|---|---|---|
| 1000129 | 1/1957 | Fed. Rep. of Germany . |
| 30822 | 3/1962 | Fed. Rep. of Germany . |

OTHER PUBLICATIONS

"Verbrennung von Abfaellen", by Karl J. Thome-Kozmiensky, published by EF-Verlag (1985), cover page and pp. 833-842.

*Primary Examiner*—Edward G. Favors

*Attorney, Agent, or Firm*—McAulay Fisher Nissen & Goldberg

[57] ABSTRACT

For the purpose of regulating the furnace output of incineration plants with a combustion grate, the primary air supply is variously regulated by zones along the length of the grate as well as in the transverse direction of the combustion grate. A monitoring device in the form of a video camera, which monitors the different burning behavior in the individual combustion zones, serves this purpose. In so doing, the recorded picture which is displayed on a monitor is resolved into individual picture lines and picture points by means of a freely programmable computer and the digital values obtained in this way, which represent a measurement for the combustion temperature, the flame radiation or the brightness on the respective combustion zone, are compared with preselected standard values. During a deviation, a corresponding regulation is carried out via a regulator, wherein regulating flaps in the air supply pipes, which guide the combustion air to the individual combustion zones, are adjusted for this purose.

7 Claims, 5 Drawing Sheets

METHOD AND APPARATUS FOR REGULATING THE FURNACE OUTPUT OF INCINERATION PLANTS

FIELD OF THE INVENTION

The invention concerns a method and an apparatus for regulating the furnace output of incineration plants with a combustion grate in which the primary air supply is regulated differently along the length of the grate by zones. The invention is also directed to an apparatus for implementing the method.

BACKGROUND OF THE PRESENT INVENTION

The course of combustion on a combustion grate varies along the length of the grate. In the vicinity of the feed, the combustible material is dried and ignited. In an adjoining area, the combustible material burns intensively, the intensity decreasing toward the end of the grate until only burnt out and cooled cinder remains shortly before the end of the grate, which cinder falls into a correspondingly constructed discharge. Because of these different phases which the combustible material passes through on the way along the grate, it is necessary to regulate the primary air supply various ways. This was previously effected by providing underblast zones below the grate which are divided in the longitudinal direction of the same, so that differing air quantities being are supplied to the latter in order to take into account the different burning phases. The primary air supply is regulated to form the individual underblast zones according to distribution curves which are calculated beforehand and can be adapted to the respective prevailing conditions by also observing the furnace bed. It is also known to regulate the furnace output as a function of the $O_2$ moist content measured in the combustion gases and/or the furnace temperature and/or the steam mass flow. In this case as well, it is governed by a computationally and empirically determined distribution of the primary air quantity with reference to the individual underblast zones.

A disadvantage in this type of furnace output regulation is the fact that the adjustment and distribution of the primary air is effected with reference to the grate width according to a mean value of the combustible material quality and that different qualities of combustible material and quantities of combustible materials are not taken into account with reference to the width. This results in a burning behavior which varies from place to place and in alternating air surplus indexes which counteract the attempt to achieve a uniform temperature profile in the furnace of the incineration plant. This can have disadvantageous consequences not only for the thermal behavior (efficiency factor) but also with respect to the emission of harmful gases.

The object of the invention is to improve the furnace output regulation in such a way that an optimal burning behavior and accordingly lower emission values, i.e. a lower environmental loading, and a thermal efficiency factor which is as uniform as possible, (a uniform steam production), is achieved along the entire combustion grate surface independently of the respective quality of combustible material.

This object is met, according to the invention, in that the primary air supply is also regulated differently by zones in the transverse direction of the combustion grate and in that the individual combustion zones are monitored and the primary air quantities are supplied to the individual combustion zones corresponding to the burning behavior of the combustible material prevailing in the respective combustion zones.

Different qualities of combustible material and different distributions of combustible material can be taken into account by means of this method, according to the invention, in such a way that an optimum combustion state prevails at all places on the combustion grate. This results in lower emission values and a high thermal efficiency factor of the plant.

The monitoring of the individual combustion zones can be effected by means of temperature measurement at a corresponding number of locations above the combustion zones in the furnace.

According to a preferred construction of the method, according to the invention, the monitoring of the individual combustion zones can be effected by means of video or thermographic cameras.

The apparatus for implementing the method with a combustion grate in which the primary air supply is effected along underblast zones divided in the longitudinal direction of the combustion grate is characterized in that the underblast zones are also divided in the transverse direction of the combustion grate and in that a monitoring device is provided for determining the burning behavior of the combustible material along the individual combustion zones assigned to the respective underblast zones.

The monitoring device can comprise the thermal elements assigned to the individual combustion zones, so that it is possible to record a temperature profile in the furnace and to influence the primary air supply in the individual combustion zones in a corresponding manner. In so doing, it is advantageous if the thermal elements are arranged between 5 and 15 m above the combustion zones.

In another construction of the invention, the monitoring device preferably comprises a thermographic or video camera, a monitor and a freely programmable computer which resolves the recorded image into individual picture lines and picture points and compares the digital values obtained in this way, which represent a measurement for the combustion bed temperature, the flame radiation or the brightness on the respective combustion zone, with preselected standard values and triggers a corresponding regulating process when there is a deviation. This type of monitoring is particularly advantageous, since the monitoring can be directed to every individual point of the combustion grate, so that an extremely sensitive regulation is possible.

The invention is explained in the following with the aid of embodiment examples of devices for implementing the method according to the invention, which devices are shown in the drawing.

DESCRIPTION OF THE PREFERRED EMBODIMENTS

Figure 1:
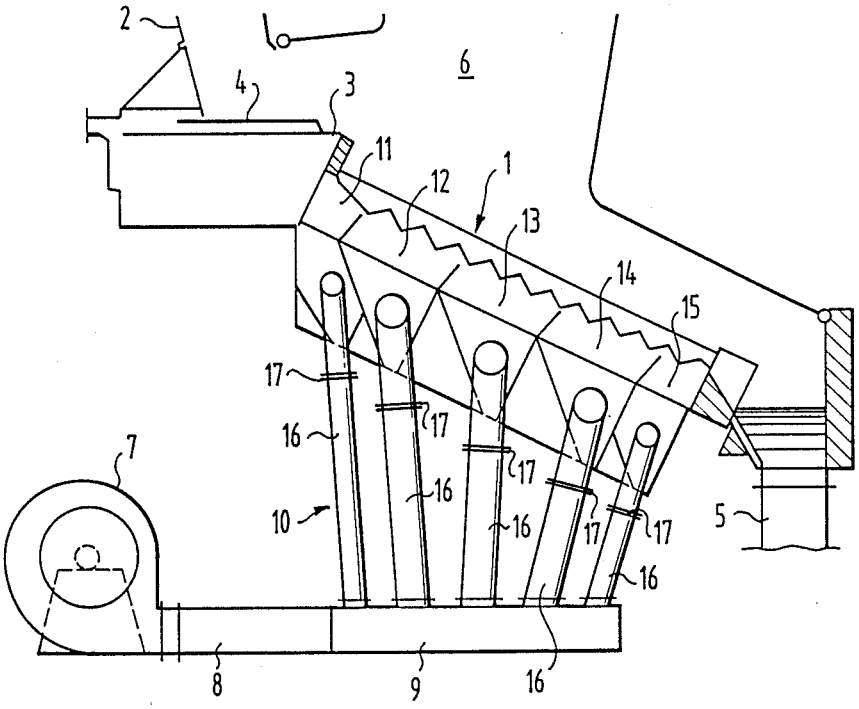
FIG. 1 shows a longitudinal section through a combustion grate with individual underblast zones.

The schematic view according to FIG. 1 shows longitudinal section through a combustion grate, designated in its entirety by 1. A feed chute 2 is provided over a feed table 3 for the purpose of feeding the combustible material, feeding pistons 4 for conveying the combustible material to the combustion grate 1 are provided on the feed table 3. The combustible material is ignited on the combustion grate 1, burned as the process continues, and finally the cinder is discharged at the end of the grate by means of a cinder drop chute 5 which opens into a discharge device, not shown. The furnace over the combustion grate 1 is designated by 6.

Figure 2:
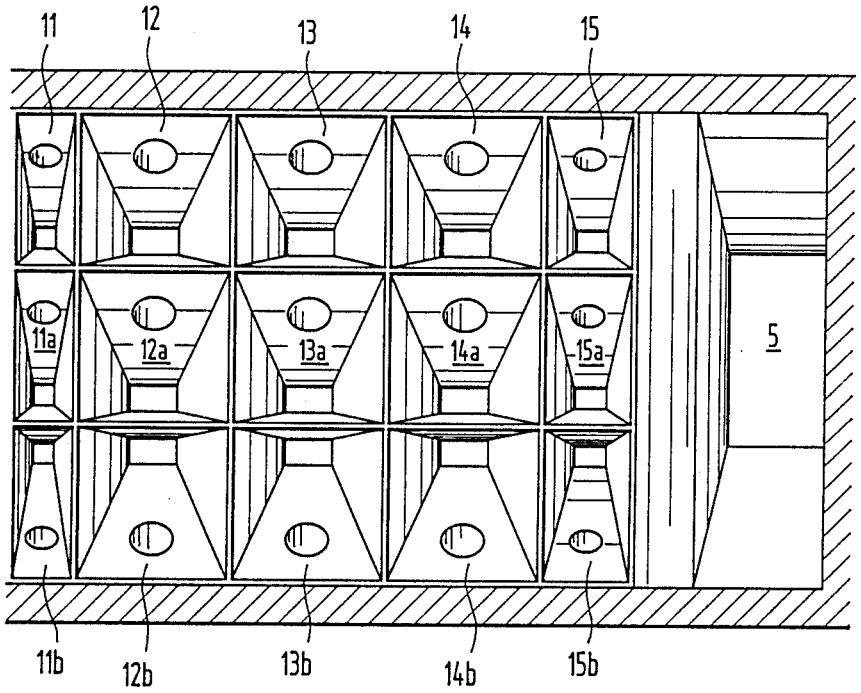
FIG. 2 shows a top view of the combustion grate according to FIG. 1.

The supply of the combustion air as primary air is effected by means of a fan 7 via a duct, designated by 8, to an underblast distributor, designated in its entirety by 9. Air supply pipes, designated in their entirety by 10, lead from the underblast distributor into individual underblast zones 11 to 15 which are divided not only in the longitudinal direction of the combustion grate, according to FIG. 1, but are also, as can be seen in FIG. 2, divided in the transverse direction of the combustion grate into individual underblast zones and are designated by the letters a and b. The duct system 10 comprises a number of air supply pipes 16 corresponding to the number of underblast zones 11*a* to 15*b*, in which the air throughput can be regulated by means of regulating devices which are shown schematically and provided with the reference number 17. The combustion grate is divided by means of this step into individual combustion zones which correspond to the underblast zones. Accordingly, it is possible to regulate every individual combustion zone corresponding to the quantity of combustible material present there and the quality of the combustible material occurring at the time, and to regulate the burning behavior of the combustible material.

In order to be able to implement such a regulation, a monitoring device is needed which monitors the burning behavior on the combustion grate. Two different possibilities for this are shown in FIGS. 3 and in FIGS. 4 and 5, respectively.

Figure 3:
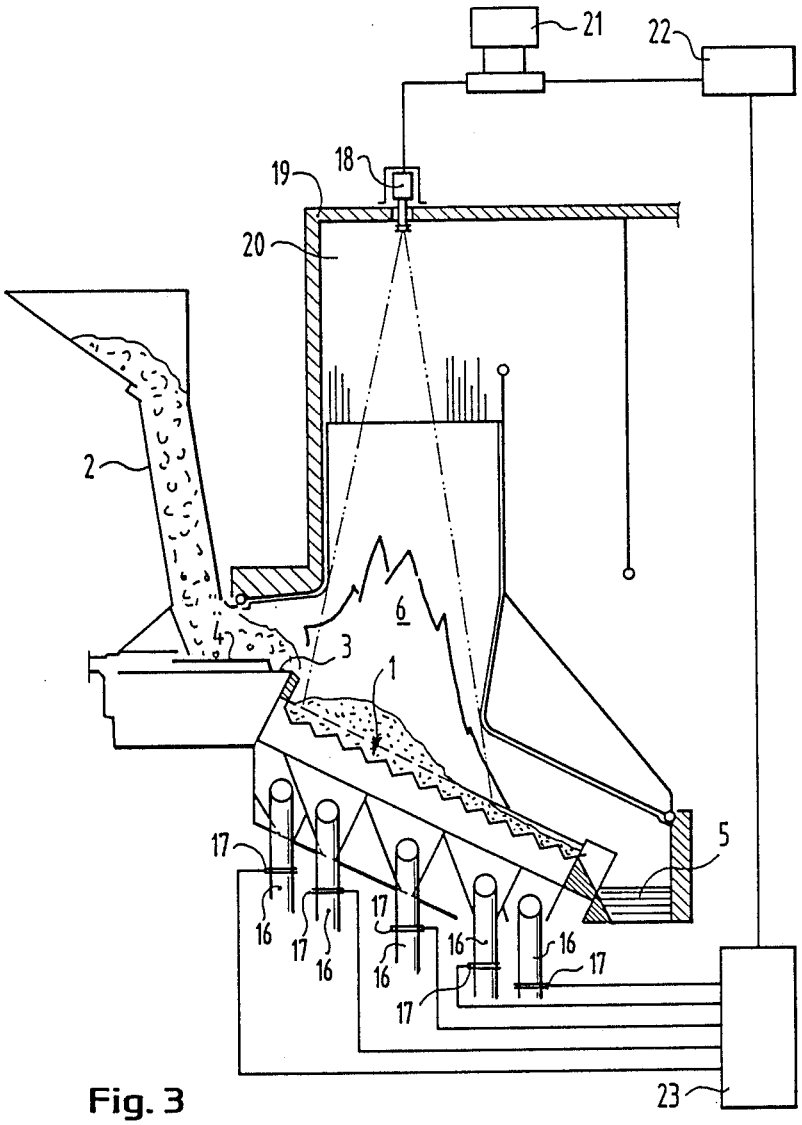
FIG. 3 shows a partial longitudinal section through an incineration plant with arrangement of a video or thermographic camera.

FIG. 3 shows the arrangement of a video or thermographic camera 18 which is provided in the cover 19 of the gas flue 20. The video camera or thermographic camera 18 is aligned in such a way that it can observe the combustion grate 1 from above through the furnace 6. This video camera is connected with a monitor 21 and with a freely programmable computer 22 which correspondingly resolves the recorded picture and compares the digital values obtained in this way with preselected standard values, the digital values representing a measurement for the brightness on the respective combustion zone, and, during a deviation, triggers a corresponding regulating process via a regulator 23 which adjusts the regulating devices in the air distribution pipes 16, the regulating devices being constructed as flaps or slides 17.

Figure 4:
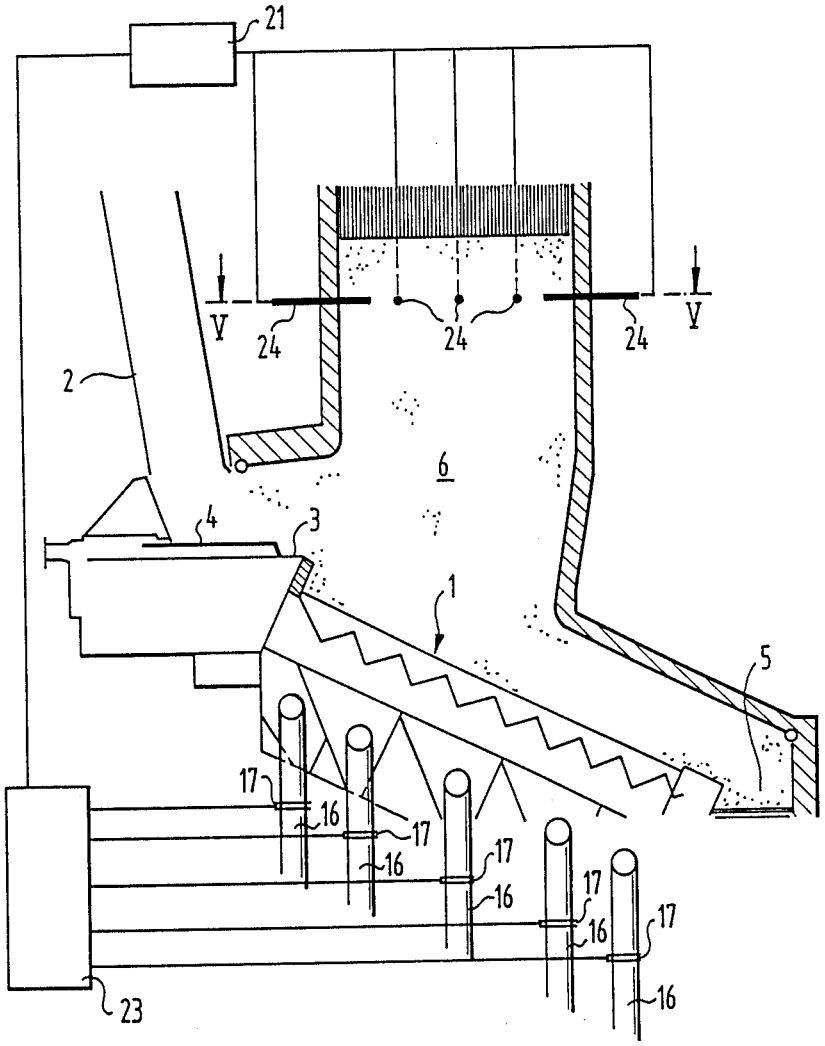
FIG. 4 shows a partial longitudinal section through an incineration plant with arrangement of thermal elements.
Figure 5:
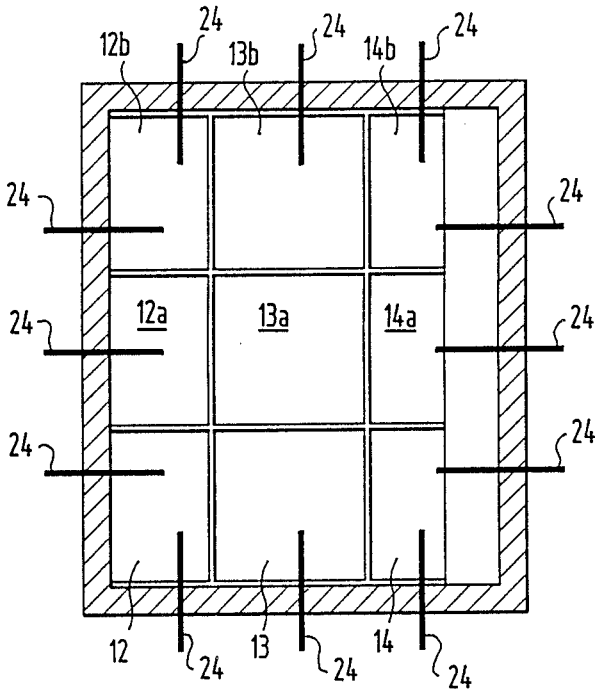
FIG. 5 shows a section through line V-V in FIG. 4 in enlarged scale.

FIGS. 4 and 5 show another monitoring device which is formed from individual thermal elements 24 which transmit the measured values to a freely programmable computer 22 which effects an adjustment of the respective regulating devices 17 in the air supply lines 16 via a regulator 23, as explained in connection with FIG. 3. FIG. 5 shows an overview of the distribution of the individual thermal elements 24. It can be seen from this that the thermal elements are uniformly distributed on the circumference of the gas flue in order to monitor as many combustion zones as possible. Both the thermal elements 24 and the video camera 18 are arranged at a height between 5 and 15 m. While the foregoing description and drawings represent the preferred embodiments of the present invention, it will be obvious to those skilled in the art that various changes and modifications may be made therein without departing from the true spirit and scope of the present invention.

What is claimed is:

1. A method for regulating the furnace output of incineration plants having a combustion grate, in which the primary air supply is regulated variously by zones along the length of the grate, the steps of the method comprising: regulating the primary air supply variously by zones in the transverse direction of the combustion grate, monitoring the individual combustion zones and supplying the primary air quantities to the individual combustion zones corresponding to the burning behavior of the combustible material prevailing in the respective zones.

2. A method according to claim 1, wherein the monitoring of the individual combustion zones is effected by means of temperature measurement above these combustion zones.

3. A method according to claim 1, wherein the monitoring of the individual combustion zones is effected by means of video or thermographic cameras.

4. An apparatus for implementing a method for regulating the furnace output of incineration plants having a combustion grate, in which the primary air supply is regulated variously by zones along the length of the grate including the steps of regulating the primary air supply variously by zones in the transverse direction of the combustion grate, monitoring the individual combustion zones and supplying the primary air quantities to the individual combustion zones corresponding to the burning behavior of the combustible material prevailing in the respective zones, said apparatus comprising that said combustion grate for the primary air supply includes underblast zones divided in the longitudinal direction of the combustion grate, said underblast zones also being divided in the transverse direction of the combustion grate, and also including a monitoring device for determining the burning behavior of the combustible material on the individual combustion zones assigned to the respective underblast zones.

5. Apparatus according to claim 4 for implementing said method, wherein the monitoring device comprises the thermal elements assigned to the individual combustion zones.

6. Apparatus according to claim 5, wherein the thermal elements are arranged between 5 and 15 m above the combustion zones.

7. Apparatus according to claim 4 for implementing said method wherein the monitoring device comprises a thermographic or video camera, a monitor and a freely programmable computer which resolves the recorded picture into individual picture lines and picture points and compares the digital values obtained in this way with preselected standard values, the digital values representing a measurement for the combustion bed temperature, the flame radiation or the brightness on the respective combustion zone, and triggers a corresponding regulating process during a deviation.

* * * * *